US008381377B1

(12) United States Patent
Poliak et al.

(10) Patent No.: US 8,381,377 B1
(45) Date of Patent: Feb. 26, 2013

(54) BRIDGE SYSTEM FOR STRING INSTRUMENTS

(76) Inventors: Eduard Poliak, Or-Akiva (IL); Mordechai Ruslan Davidov, Hadera (IL); Alexander Khaskin, Or-Akiva (IL)

( * ) Notice: Subject to any disclaimer, the term of this patent is extended or adjusted under 35 U.S.C. 154(b) by 0 days.

(21) Appl. No.: 13/385,026

(22) Filed: Jan. 30, 2012

(51) Int. Cl.
*G10D 3/04* (2006.01)

(52) U.S. Cl. ..... 28/298

(58) Field of Classification Search ..... 84/307, 84/312 R, 313
See application file for complete search history.

(56) References Cited

U.S. PATENT DOCUMENTS

2005/0188814 A1* 9/2005 Bell et al. ..... 84/298

* cited by examiner

*Primary Examiner* — Kimberly Lockett
(74) *Attorney, Agent, or Firm* — Law Offices of Steven W. Weinrieb

(57) ABSTRACT

A bridge system for a string instrument includes a plate that is bonded to a string instrument soundboard. The plate has a plurality of first holes for respectively receiving a string ball end. A bridge box is attached to the underside of the plate. The bridge box has a bottom plate with a plurality of second holes aligned with third holes within the plate for accommodating a string ball end entrapper. The entrapper entraps the string ball end within the bridge system.

11 Claims, 3 Drawing Sheets

BRIDGE SYSTEM FOR STRING INSTRUMENTS

FIELD OF THE INVENTION

The present invention relates to string instruments such as acoustic guitars and, more particularly to bridge systems of acoustic guitars.

BACKGROUND OF THE INVENTION

An acoustic guitar typically includes a hollow resonant box that amplifies the vibrating sound of the strings under soundboard of the guitar body. The resonant box is completed by back plate and side ribs. The guitar strings are installed at the guitar bridge that is fixed to the surface of the soundboard. The end of each string is typically held by means of a tapered pin. The string is rolled onto a tuning bolt or peg at the other end of the guitar neck. At the bottom part of the guitar bridge, a plurality of string tapered holes is provided. The tapered holes have a tapered surface, and there is one for each guitar string.

The method used to anchor an acoustic guitar strings to the guitar body have been by means of tapered pins or bridge pins which are installed, along with the guitar strings, into the tapered holes through the bridge, the soundboard, and the bridge saddle. The tapered pins entrap the ball-ends of the guitar strings to the underside of the bridge plate. From there the strings extend the full length of the fingerboard and seat in the nut before wrapping around a tuner located on the headstock. The tensioning on the strings is then increased by tuning the tuner until the desired pitch is achieved. All the guitar strings are put on the guitar in the same manner.

The problem with this method is that the guitar strings from the bridge saddle to the string anchor points contact wood at high forces, which causes the wood to deform.

Another problem with this method is that, instruments such as acoustic guitars typically use the tapered pins to hold down the strings. These pins need to be removed every time the strings need to be replaced, but the pins are so firmly placed that they cannot be removed by bare hands but need a tool (such as pliers, nippers, or the like), however such tools may damage expensive musical instruments and tapered pins of high quality material such as ivory, ebony, or the like.

Patent application number JP2011043780 discloses a bridge mechanism for string instruments, wherein the mechanism includes a bridge having a string length correcting function, and a string end-holding mechanism that eliminates the need for a fixing pin, that can exchange the strings, and that does not protrude toward an upper surface in the string instrument, such as, acoustic guitar. The bridge mechanism includes a bridge part and a string end-holding mechanism part. The mounting position for the bridge part is finely adjustable by attaching the bridge to the upper surface of the sounding board using a bolt nut. The string end-holding mechanism hold and release the end of the string, by changing an operation direction of the string, and the string holding mechanism part fixes the bridge part and the string end-holding mechanisms to the upper backside.

An object of the present invention is to provide an efficient method to hold down to the strings at the bridge system without damaging or deforming the guitar wood or pin holes.

Yet another object of the present invention is to provide a system for holding the guitar strings without the use of tapered pins.

SUMMARY OF THE INVENTION

The present invention relates to string instruments such as acoustic guitars and, more particularly to bridge systems of acoustic guitars.

In accordance with an embodiment of the present invention there is provided a bridge system for a string instrument with a plurality of string ball-ends, the bridge system includes a plate that is bonded to a string instrument soundboard, the plate has a plurality of tapered holes, one hole for each string ball-end. At the bottom part of the plate there is provided a plurality of tapered holes for a string ball-end entrapper, one hole for each string ball-end entrapper.

A bridge box is attached to the underside of the plate; the box has a bottom plate with a plurality of tapered holes aligned with the holes for a string ball-end entrapper. The string ball-end entrapper is constructed from an elongated cylindrical rod with tapered ends, and an arm extends vertically from the cylindrical rod. A coiled spring is mounted coaxially around the rod part below the arm, seated between the arm and the box bottom plate, the rod part above the arm protruding outwards from the hole for the string ball-end entrapper. A saddle is mounted on said plate.

Wherein, in order to entrap the string ball-end within the box, the coiled spring is initially positioned in its extended position, then a user presses downwardly upon the upper portion of the rod part that is above the arm. When the user manually presses downwardly upon the upper portion of the rod, the coiled spring is compressed and as long as the user presses downwardly upon the upper portion of the rod, the user is able to insert the string ball-end into the box through tapered hole for the string ball-end such that at least a portion of the ball-end is positioned below the arm. Accordingly, when the string ball-end is tensioned, a force is applied towards the bottom surface of the arm preventing the upper portion of the rod from being pressed downwardly, the upper portion of the rod can be pressed downwardly, and the string ball-end can be released from the hole for the string ball-end when the tension of the string becomes loosened for example when the string is torn or when the rolled string upon the tuning bolt is loosened so as to permit the string to be less tensioned.

BRIEF DESCRIPTION OF THE DRAWINGS

The invention may be understood upon reading of the following detailed description of non-limiting exemplary embodiments thereof, with reference to the following drawings, in which.

The following detailed description of the invention refers to the accompanying drawings referred to above. Dimensions of components and features shown in the figures are chosen for convenience or clarity of presentation and are not necessarily shown to scale. Wherever possible, the same reference numbers will be used throughout the drawings and the following description to refer to the same and like parts.

DETAILED DESCRIPTION OF EMBODIMENTS OF THE INVENTION

Figure 1:
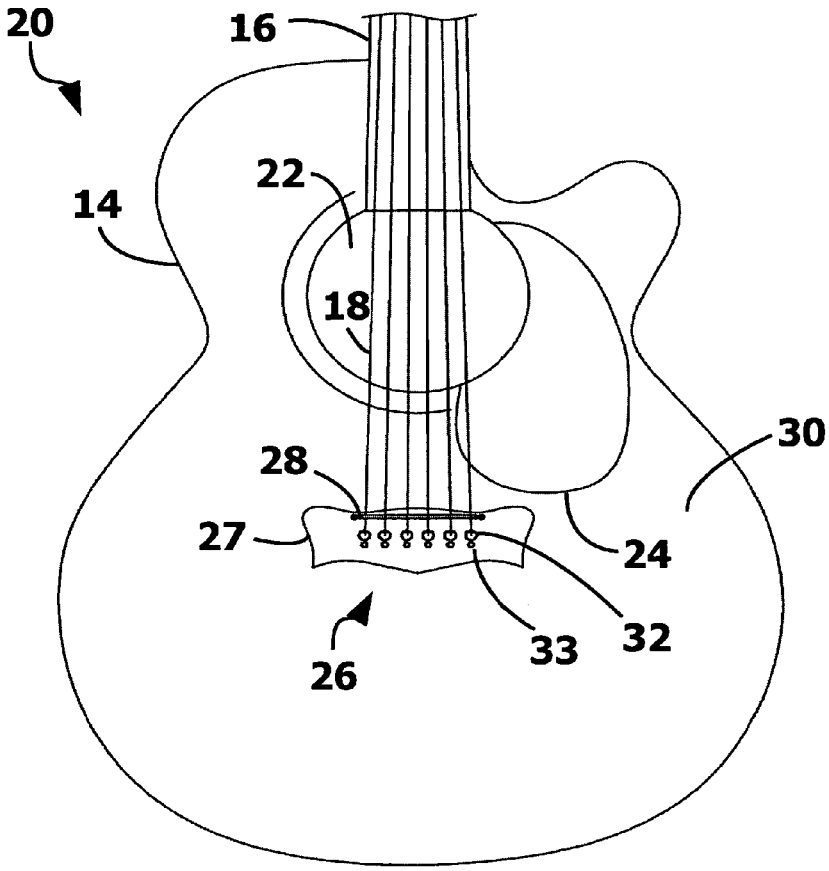
FIG. 1 is a front view of an acoustic guitar in accordance with some embodiments of the present invention.
Figure 2:
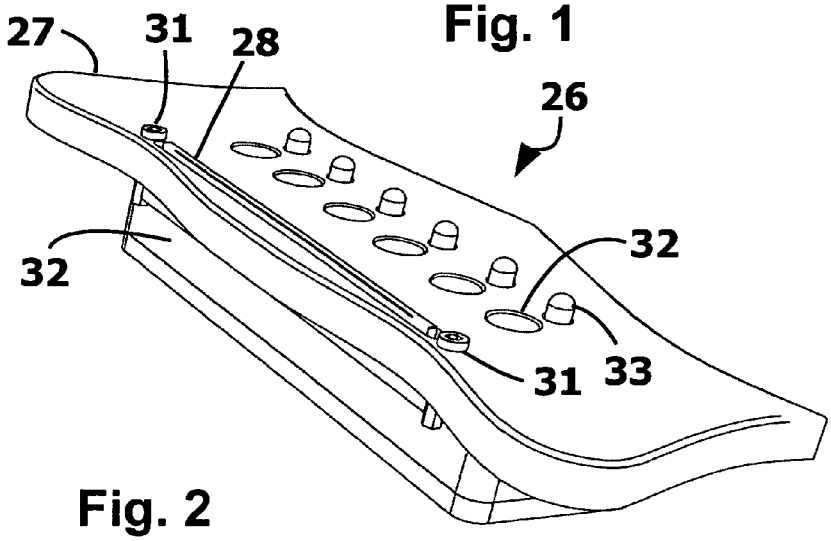
FIG. 2 is a perspective view of a bridge system in accordance with some embodiments of the present invention.

Referring first to FIG. 1, there is shown a body 14 and a fingerboard 16 of an acoustic guitar 20. The fingerboard is partially shown, and the headstock of the guitar is not shown. Guitar strings such as strings 18 run down fingerboard 16 over the frets, not shown. When the guitar player strums strings 18 over a sound-hole 22, this is where the vibrations from the strings are acoustically reflected out providing the sound from the instrument. Acoustic-electric guitars have a pickup inside the sound-hole 22; add-on acoustic pickups can also be used to turn any acoustic guitar into an acoustic-electric guitar. Most acoustic guitars have a pick-guard 24 which is typically a dark and smooth piece that is located right next to the sound-hole 22. As the guitar player strums the guitar 20, his hand will naturally travel downward against body 14 and the pick guard 24 is there to protect the body 14 from scratches.

Strings 18 terminate in a bridge system 26 which anchors strings 18 to body 14. Bridge system 26 has a bridge plate 27 that is bonded to the guitar soundboard 30 by using any suitable fastening means or adhesive such as glue. The bridge plate 27 may be fabricated of ebony, rosewood, or any other suitable material, and can be made as light as possible so as to minimize the loss of string vibratory energy required to excite the bridge 26.

The bridge system 26 may also include a saddle 28 which is a small strip usually made of plastic, bone, synthetics, or some exotic animal tooth variations (for example, fossilized tooth, ivory, or the like). The purpose of the saddle 28 is to raise the strings up above the body 14 and fingerboard 16 so as to establish the "action" of the guitar. "Action" is a well known term used by musicians and instruments manufactures to describe the way an instrument is adjusted and how well it plays. "Action" is most commonly thought of as how high the strings are from the frets. The bridge system 26 in accordance with the present invention may include a fixed saddle or an adjustable saddle. The guitar shown in FIG. 1 has an adjustable saddle 28; the height of the saddle 28 can be adjusted by screws 31. Bridge system 26 may include other suitable saddles and/or adjustable saddles known to one of ordinary skill in the art. The general main purpose of bridge 26 on an acoustic guitar is to transfer the vibration from the strings to soundboard 30, which vibrates the air inside of the guitar, thereby amplifying the sound produced by strings 18.

Figure 5:
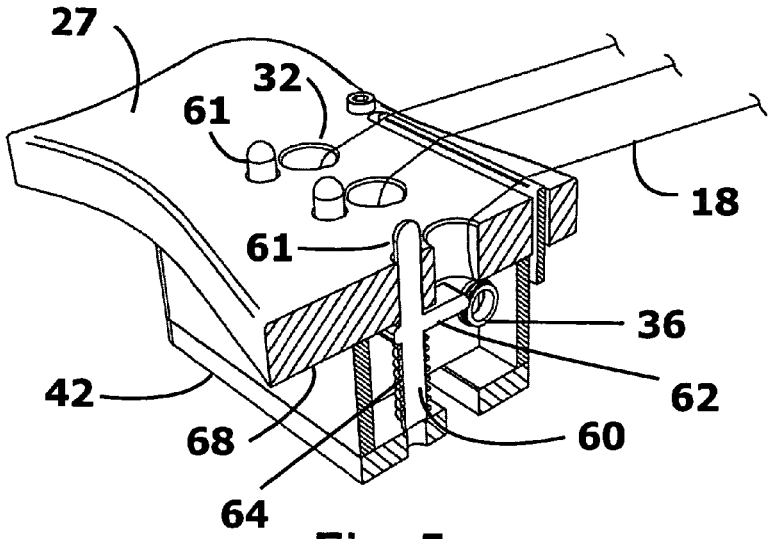
FIG. 5 is a sectional perspective view of the bridge system of FIG. 2 where the ball-end of a guitar string is entrapped within the hole of the bridge system and the guitar strings are tensioned.

Plate 27 of bridge 26 has a plurality of tapered holes such as hole 32, and there is one hole 32 for each guitar string ball-end 36 as shown for example in FIG. 5. Holes 32 are disposed in a parallel and spaced relationship with respect to one another as shown for example in FIG. 3. At the bottom part of plate 27, a plurality of tapered holes for string ball-end entrappers 33, such as the hole 34, are provided, and there is one hole 34 for each string ball-end entrapper 33. Holes 34 are disposed in parallel and spaced relationship with respect to one another as shown for example in FIG. 3.

Figure 3:
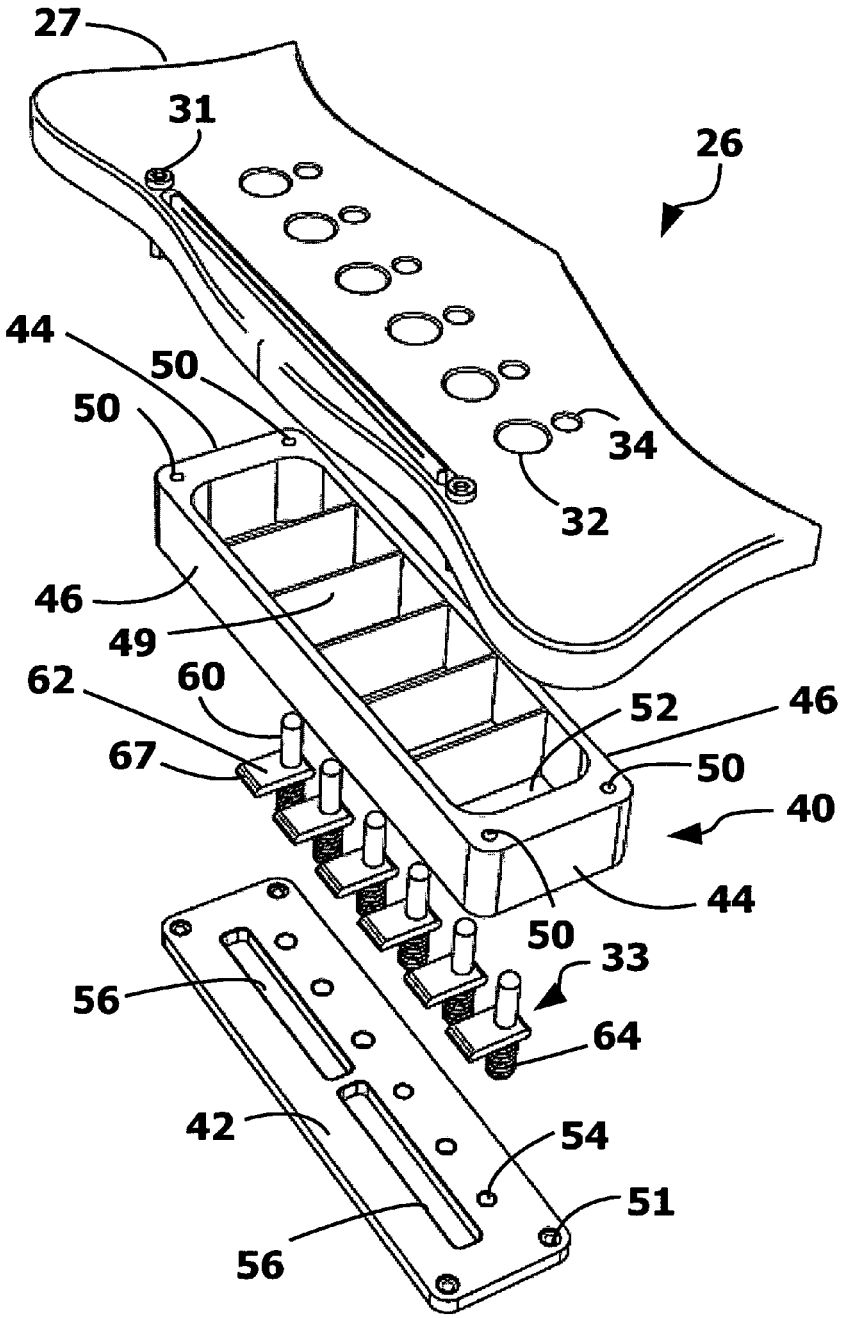
FIG. 3 is an exploded perspective view of the bride system of FIG. 2.

Referring also to FIG. 3, a bridge box 40 is attached to the underside of plate 27 by any suitable attaching means such as gluing and screws. Preferably, bridge box is fabricated of ebony, rosewood, or any other suitable material, and can be made as light as possible. Box 40 has a rectangular shape and is constructed from a bottom plate 42, two end ribs 44 opposite to one another, and two longitudinal ribs 46 opposite to one another. In each corner of box 40 and plate 42, through holes 50 and 51 are provided and aligned with respect to one another for attaching plate 42 to the bottom surface of ribs 46 and 44 by any suitable attaching means such as nails or screws penetrably engaging holes 50. In some embodiments of the present invention, box 40 is provided with a plurality of divider members 49 for dividing box 40 into an even number of compartments, such as compartment 52, and the number of compartments is in accordance with the number of acoustic guitar strings, so, in this example, since there are six guitar strings 18, box 40 has six compartments. The divider members 49 are positioned within box 40 so as to extend between the box side ribs 46 so as to form the compartments 52. The divider members 49 can be made of any material such as wood, plastic and various composites. Plate 42 includes a plurality of tapered holes 54, one hole for each string ball-end entrapper 33. Plate 42 further includes slots 56 disposed adjacent to the holes 54 so as to reduce the weight of the box 40. In some embodiments of the present invention, the slots 56 are made wider than the string ball-ends 36 for optionally removing the string ball-ends 36 from the bridge 26, such as, for example when a string 18 of the ball-end 36 tears.

String ball-end entrappers 33 are constructed from elongated cylindrical rods 60 with tapered ends, arms 62, and coiled springs 64. Arms 62 extend horizontally from cylindrical rods 60 as viewed in FIG. 3. Rods 60 and arms 62 are preferably made of metal; however the arms and rods can be made of other suitable rigid material. The extension can be inexpensively produced by the utilization of conventional molding or fabricating techniques. Preferably, arms 62 extends from the middle portions of the cylindrical rods 60. A coiled spring 64 is mounted coaxially around the rod part below the arm 62 and is seated between each arm 62 and the box bottom plate 42 as shown for example in FIG. 3. Preferably, the diameter of each rod 60 is less than the diameter of each hole 54, and the diameter of each coiled spring 64 is greater than that of each hole 54 such that each rod 60 is able to be moved downwardly and each coiled spring 64 will be compressed when a force is applied downwardly, the direction of the force being designated by arrow 63 as shown for example in FIG. 4. Holes 54 and 34 receive the cylindrical rods 60, the bottom end portion of each cylindrical rod 60 engaging with hole 54, while each hole 34 receives that part of rod 60 that is disposed above arm 62 such that the upper end portion 61 of each rod 60 extends outwardly from each hole 34 as shown in FIG. 5. When a user presses the upper end of the rod 60 downwardly in the direction designated by arrow 63, the rod 60 is moved downwardly whereby the arm 62 compresses the coiled spring 64 and the bottom portion of the cylindrical rod 60 partially passes through the hole 54 as shown for example in FIG. 4. When a user releases the pressure upon the upper end of rod 60, coiled spring 64 expands upwardly and applies a force that urges the rod 60 upwardly until the upper surface of arm 62 engages with the bottom surface of bridge plate 27 as can be appreciated from FIG. 5.

Figure 4:
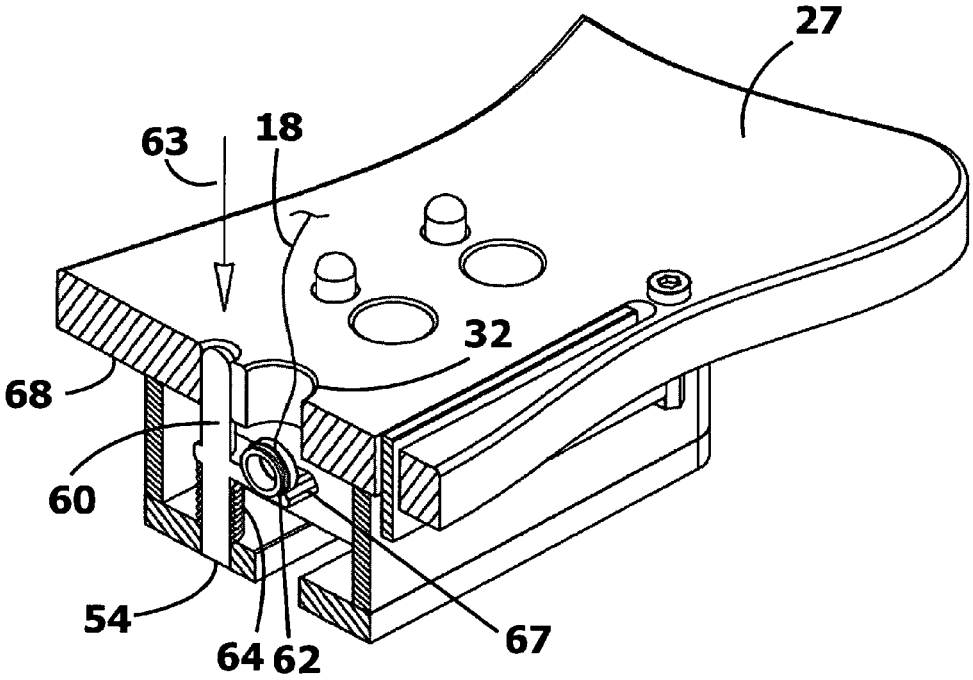
FIG. 4 is a sectional perspective view of the bridge system of FIG. 2 wherein the ball-end of a guitar string is inserted into a hole of the bridge system.

Referring now to FIGS. 3, 4 and 5, in operation, in order to entrap each string ball-end 36 within a respective one of the compartments 52 of box 40, a user such as a guitar player presses the upper portion 61 of rod 60 downwardly, which is the portion of the rod 60 that protrudes outwardly from the upper surface of the bridge plate 27 when the coiled spring 64 is in its expanded position or state. When the user manually presses the upper portion 61 of the rod 60 downwardly, the coiled spring 64 is compressed and energy is stored in the coiled spring 64. As long as the user presses the upper portion 61 of the rod 60 downwardly, the user can insert each string ball-end 36 into its compartment 52 through the tapered hole 32 such that the ball-end 36, or part of ball-end 36, is positioned below the arm 62 as shown for example in FIG. 5. In some embodiments of the present invention the far end of each arm 62 has a curved end portion 67 as shown for example in FIG. 4 for easily guiding string ball-end 36 into the compartment 52.

After the string ball-end 36 has been inserted into its compartment 52, in order to entrap the string ball-end 36 inside the compartment 52, the user stops pressing upon the rod upper portion 61 whereby stored energy from the coiled spring 64 is released, coiled spring 64 expands, and the force of the coiled spring 64 pushes the arm 62 of rod 60 upwardly until the arm 62 engages with the bottom surface 68 of the bridge plate 27 as seen in FIG. 5. When the arm 62 engages the bottom surface 68 of the bridge plate 27, the passage from the tapered hole 32 into the compartment 52 is partially or fully blocked, thus preventing the ball-end 36 from being released out from the hole 32. When the user wants to release ball-end 36 of the string 18 from the compartment 52 through the tapered hole 32, he simply releases the tension of the string 18, and after pressing the upper end portion 61 of the rod 60 downwardly, arm 62 is moved downwardly and the passage between the hole 32 and the compartment 52 is again enlarged such that the string ball-end 36 can be released through the tapered hole 32 for example by manually pulling the guitar string 18 out of the hole 32.

It should be understood that the above description is merely exemplary and that there are various embodiments of the present invention that may be devised, mutatis mutandis, and that the features described in the above-described embodiments, and those not described herein, may be used separately or in any suitable combination; and the invention can be devised in accordance with embodiments not necessarily described above. For example, the invention could be utilized on other types of string instruments having string ball-ends such as violin, banjoes, electric guitars, mandolins, lutes and the like.

The invention claimed is:

1. A bridge system for a string instrument with a plurality of string ball-ends, said bridge system comprising:

a string instrument soundboard;

a plate mounted upon said string instrument soundboard;

said plate having a plurality of first holes defined therein for respectively accommodating a plurality of string ball-ends;

said plate having a plurality of second holes defined therein for respectively accommodating a plurality of string ball-end entrappers for engaging said plurality of string ball-ends; and a bridge box attached to an underside portion of said plate, wherein said bridge box has a plurality of holes defined within a bottom plate thereof which are respectively aligned with said plurality of second holes of said plate for said plurality string ball-end entrappers;

each one of said string ball-end entrappers comprising a cylindrical rod, an arm extending horizontally from a central portion of said cylindrical rod, a coiled spring mounted coaxially around a lower end portion of said rod disposed below said arm so as to be seated between said arm and said bottom plate of said bridge box, while an upper end portion of said rod, above said arm, protrudes outwardly from a respective one of said second holes defined within said plate, each one of said coiled springs normally biasing said arm into contact with an underside portion of said plate so as to effectively block each one of said plurality of first holes defined within said plate;

whereby, in order to insert and entrap each one of said string ball-ends within said bridge box, a user presses downwardly upon each one of said upper end portions of said rods so as to compress said coiled springs and remove said arms from their positions blocking said plurality of first holes defined within said plate such that said user is able to insert said string ball-ends into said bridge box through a respective one of said first holes defined within said plate, whereupon release of pressure upon said upper end portions of said rods, said springs expand to their normal states whereby said arms again block said plurality of first holes defined within said plate thereby entrapping said string ball-ends within said bridge box.

2. The bridge system as set forth in claim 1, wherein:

said rods are movable within said plurality of second holes defined within said plate from their first normal upward positions, as biased by said coiled springs acting upon said arms, downwardly against biasing forces of said coiled springs to second downward positions so as to again move said arms from said positions blocking said plurality of first holes defined within said plate to positions again unblocking said plurality of first holes defined within said plate such that said string-ball ends can be removed from said bridge box.

3. The bridge system according to claim 1, wherein said string instrument is an acoustic guitar.

4. The bridge system according to claim 1, wherein said bridge is provided with a divider member for dividing said box into an even number of compartments and the number of compartments is according to the number of the instrument strings.

5. The bridge system according to claim 1, wherein said bottom plate of said box have at least one slot placed above said holes of said bottom plate, wherein said slot is wider than string ball-end of said musical instrument for optionally taken out said ball-end from said bridge.

6. The bridge system according to claim 1, wherein the far end of said arm from said rod have a curved plan for easily guiding said string ball-end into said box.

7. The bridge system according to claim 1, wherein said arm and said rod are made of metal.

8. The bridge system according to claim 1, wherein a saddle mounted on said plate.

9. The bridge system according to claim 7, wherein said saddle is adjustable.

10. A method of entrapping string ball-ends of a stringed instrument having a string instrument soundboard, comprising the steps of:

providing a plate upon said string instrument soundboard;

providing said plate with a plurality of first holes for respectively accommodating a plurality of string ball-ends;

providing said plate with a plurality of second holes for respectively accommodating a plurality of string ball-end entrappers for engaging said plurality of string ball-ends;

attaching a bridge box to an underside portion of said plate, wherein said bridge box has a plurality of holes defined within a bottom plate thereof which are respectively aligned with said plurality of second holes of said plate for said plurality string ball-end entrappers;

forming each one of said string ball-end entrappers so as to comprise a cylindrical rod, an arm extending horizontally from a central portion of said cylindrical rod, a coiled spring mounted coaxially around a lower end portion of said rod disposed below said arm so as to be seated between said arm and said bottom plate of said bridge box, while an upper end portion of said rod, above said arm, protrudes outwardly from a respective one of said second holes defined within said plate, each one of said coiled springs normally biasing said arm into contact with an underside portion of said plate so as to effectively block each one of said plurality of first holes defined within said plate; and pressing downwardly upon each one of said upper end portions of said rods so as to compress said coiled springs and remove said arms from their positions blocking said plurality of first holes defined within said plate such that said user is able to insert said string ball-ends into said bridge box through a respective one of said first holes defined within said plate, whereupon release of pressure upon said upper end portions of said rods, said springs expand to their normal states whereby said arms again block said plurality of first holes defined within said plate thereby entrapping said string ball-ends within said bridge box.

11. The method as set forth in claim 10, further comprising the step of:

pressing downwardly upon each one of said upper end portions of said rods, after said string-ball ends have been entrapped within said bridge box, so as to again move said arms from said positions blocking said plurality of first holes defined within said plate to positions again unblocking said plurality of first holes defined within said plate such that said string-ball ends can be removed from said bridge box.

* * * * *